US006138734A

United States Patent [19]

Hamisch, Jr.

[11] Patent Number: 6,138,734

[45] Date of Patent: Oct. 31, 2000

[54] HAND-HELD LABELER AND METHOD OF MAKING SAME

[75] Inventor: Paul H. Hamisch, Jr., Franklin, Ohio

[73] Assignee: Monarch Marking Systems, Inc., Dayton, Ohio

[21] Appl. No.: 08/371,642

[22] Filed: Jan. 12, 1995

[51] Int. Cl.[7] ..... B41M 1/00; B65C 1/00

[52] U.S. Cl. ..... 156/384; 156/579

[58] Field of Search ..... 156/523, 527, 156/574, 577, 579, 384; 264/273

[56] References Cited

U.S. PATENT DOCUMENTS

| | | |
|---|---|---|
| 1,823,562 | 9/1931 | Husted . |
| 1,934,256 | 11/1933 | Bronson . |
| 2,071,921 | 2/1937 | Dickson . |
| 2,656,063 | 10/1953 | Kafka . |
| 2,931,110 | 4/1960 | Pietrocola . |
| 3,265,553 | 8/1966 | Kind et al. . |
| 3,440,123 | 4/1969 | Hamisch, Sr. . |
| 3,783,083 | 1/1974 | Jenkins . |
| 4,035,225 | 7/1977 | Hamisch, Jr. et al. . |
| 4,116,747 | 9/1978 | Hamisch, Jr. . |
| 4,563,235 | 1/1986 | Karn . |
| 4,724,034 | 2/1988 | Becker . |
| 5,403,430 | 4/1995 | Araujo et al. . |

*Primary Examiner*—Richard Crispino
*Attorney, Agent, or Firm*—Joseph J. Grass

[57] ABSTRACT

There is disclosed a hand-held labeler for printing and applying labels releasably adhered to a carrier web. The labeler has a handle with an outer elastomeric member provided by a layer of an elastomeric material. The elastomeric member serves as a cushion and also provides a certain amount of friction when the handle is held in the user's hand.

8 Claims, 3 Drawing Sheets

HAND-HELD LABELER AND METHOD OF MAKING SAME

BACKGROUND OF THE INVENTION

1. Field of the Invention

This invention relates to the art of hand-held labelers and to methods of making same.

2. Brief Description of the Prior Art

The following prior art United States patents are made of record: U.S. Pat. Nos. 4,116,747 and 4,724,034.

SUMMARY OF THE INVENTION

The invention is directed to a hand-held labeler which uses a composite web of labels in roll form. The composite web is comprised of labels releasably adhered to a carrier web. The labeler is intended to be held in the user's hand and can be moved around to print and apply labels to desired articles.

It is a feature of the invention to improve on labelers in the prior art to make them more comfortable to use and more user-friendly. This feature involves providing the handle of the labeler with elastomeric material which will help to cushion the handle in the palm of the user's hand and will help prevent slippage of the handle in the user's palm. The elastomeric material enables the handle to yield and help fit hands of a variety of sizes and shapes. During use of a labeler to label items, the user's hand is subjected to repeated impact, and the impact is concentrated at pressure points in the user's hand. The elastomeric material helps to absorb the impact and to distribute force concentration.

According to one preferred embodiment of the invention, the elastomeric material is molded directly onto the handle. In particular, the handle is comprised of a pair of handle sections. Elastomeric material is molded onto each handle section before the handle sections are assembled.

DETAILED DESCRIPTION OF THE PREFERRED EMBODIMENT

Figure 1:
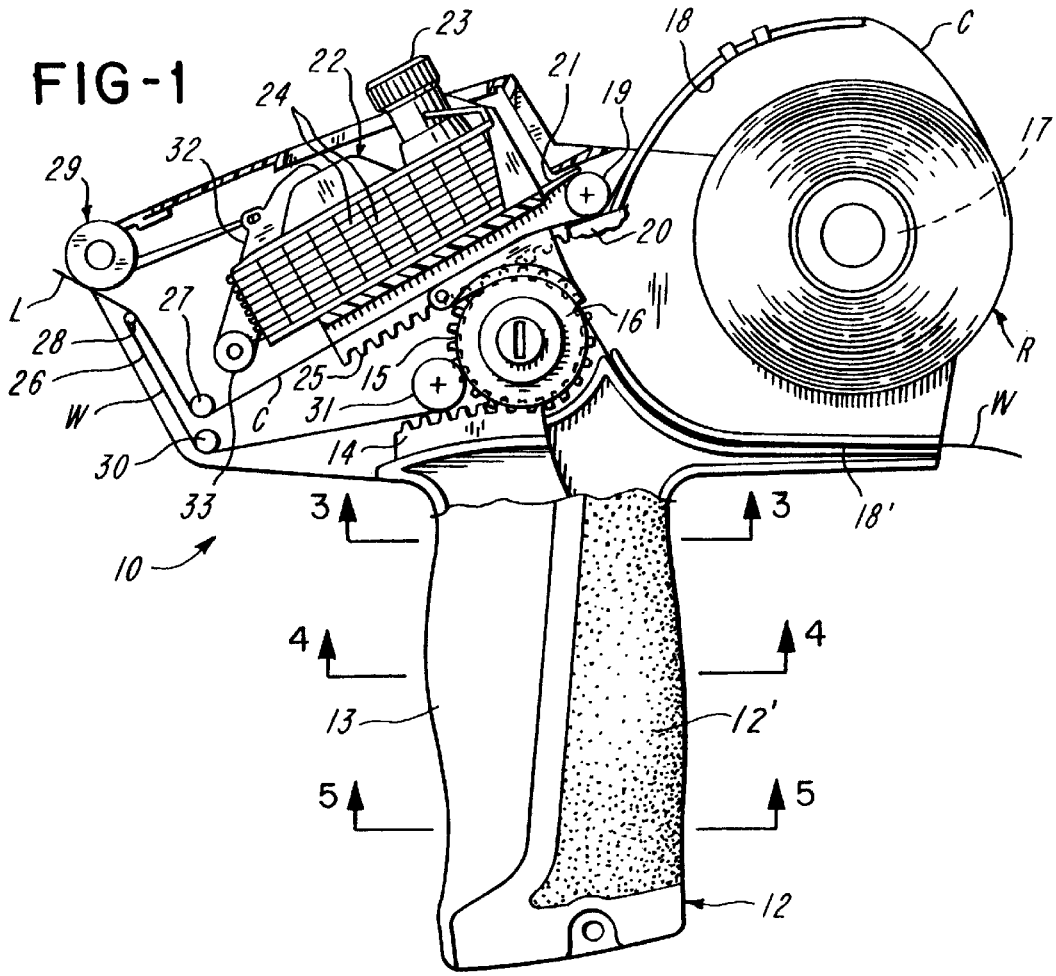
FIG. 1 is a diagrammatic view of a hand-held labeler of the invention.
Figure 2:
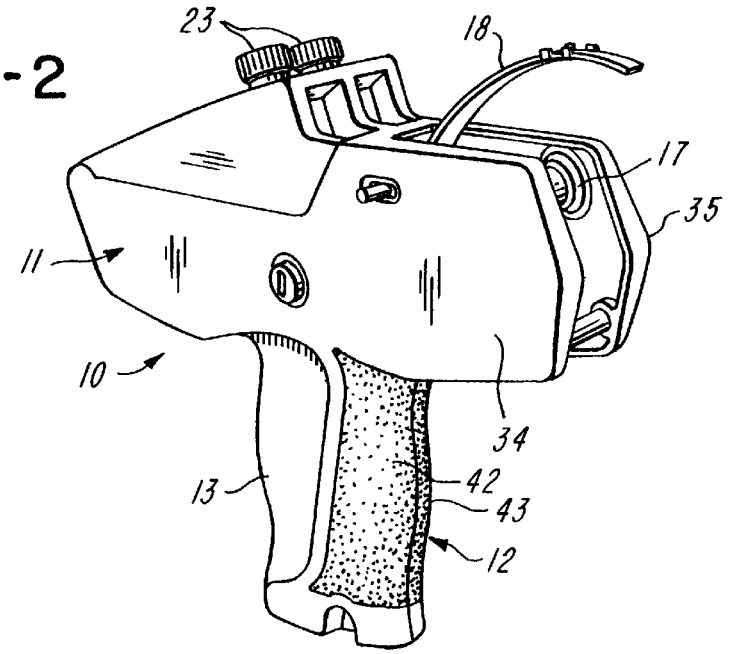
FIG. 2 is a perspective view of the labeler shown in FIG. 1.

With reference to FIGS. 1 and 2, there is shown a hand-held labeler generally indicated at 10 having a housing generally indicated at 11. The housing has a handle generally indicated at 12. An actuator in the form of an operating lever 13 is disposed at the handle 12 and is preferably pivoted near the outer end of the handle 12. The inner end of the lever 13 has a pair of curvilinear racks or gear sectors 14 for engaging a pair of gears 15 which in turn drive a pair of racks 25 and one of the gears 15 drives a toothed feed wheel 16.

A composite web C comprised of labels L releasably adhered to a carrier web W is shown in a roll R in FIG. 1. The roll R is mounted on opposed roll mounting members 17. The composite web C is paid out from the roll R and passes over a curved leaf spring 18. From there the web C passes between a brake roll 19 and a back-up member 20. The brake roll 19 is operable by an extension 21 on a print head 22. The print head 22 has a pair of selectors 23 for advancing printing bands 24 on the print head 22. The gear 15 is coupled to the pair of racks 25 on the print head 22 for moving the print head 22 into and out of printing cooperation with a platen 26. As shown, the composite web C passes partly around a guide roll 27 and partly about a delaminator 28 in the form of a peel roller where labels L are delaminated from the carrier web W. The leading label L is shown advanced into label applying relationship with respect to an applicator 29 in the form of a roll. From there the carrier web W passes partly about a guide roller 30 and from there the web W passes between the feed wheel 16 and a cooperable back-up roll 31. After passing partly around the toothed feed wheel 16, the web W passes through a discharge chute 18' to the outside of the labeler 10. An inker 32 carries an ink roller 33 which inks the printing bands 24 during movement of the print head 22.

Figure 7:
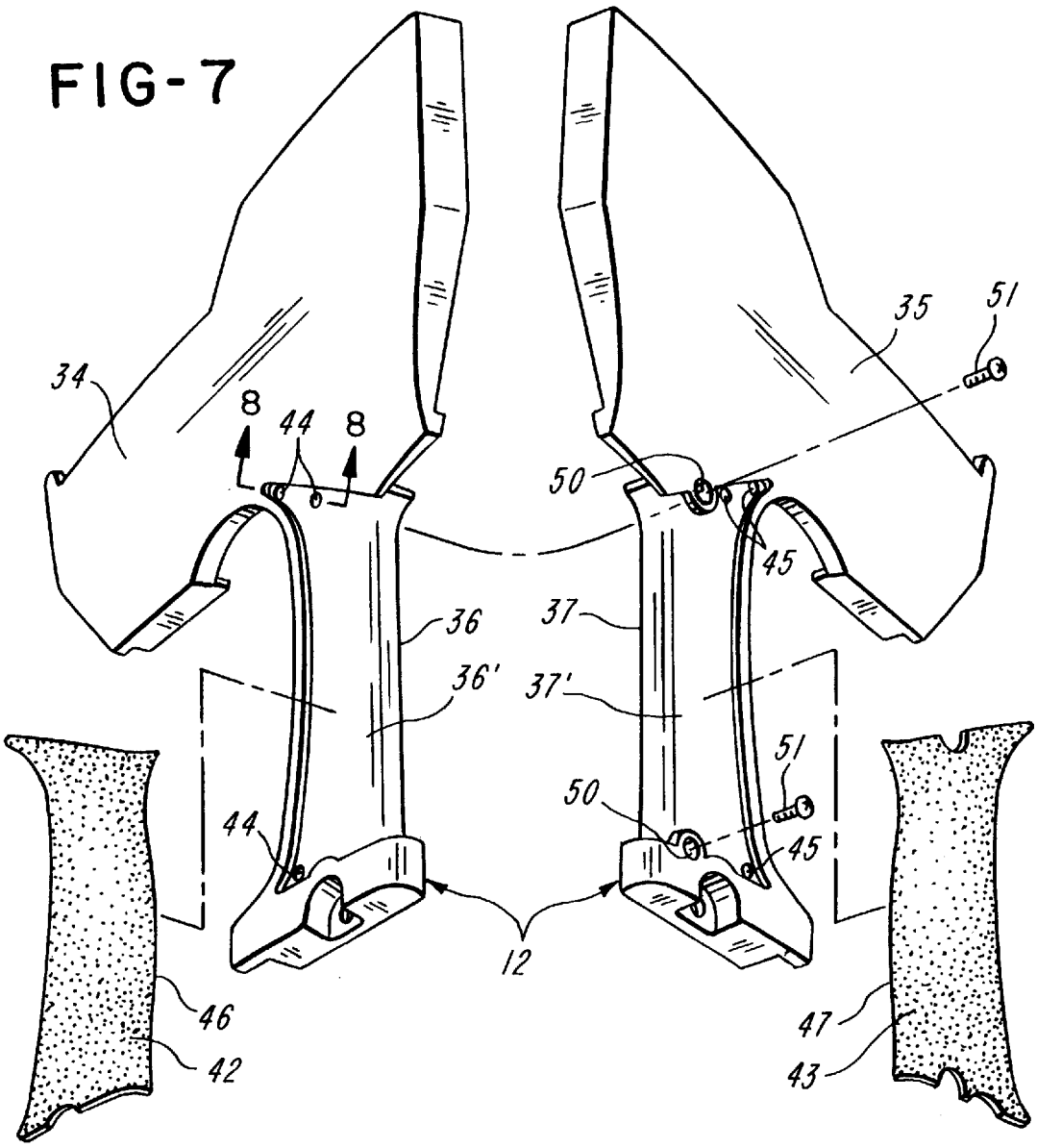
FIG. 7 is a rotated perspective view of two opposed housing sections.

The handle 12 is shown in FIG. 7 to include handle sections 36 and 37. The handle sections 36 and 37 are part of the respective housing sections 34 and 35. Almost the entire labeler 10, including the housing sections 34 and 35, is comprised of molded plastics material. The housing sections 34 and 35, in particular, are preferably composed of a plastics material known as ABS. Thus far in this Detailed Description of the Preferred Embodiment, the labeler 10 is the same as the labeler disclosed in U.S. Pat. No. 4,116,747, incorporated herein by reference.

Figure 6:
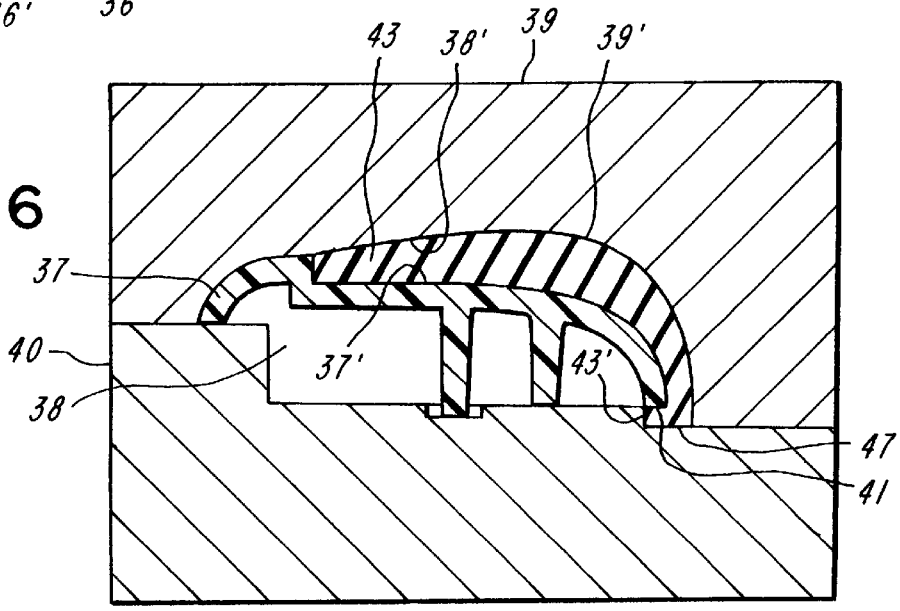
FIG. 6 is a diagrammatic sectional view through a mold showing the manner in which elastomeric material is molded onto a handle section.

During the molding of the housing sections 34 and 35, according to the invention, recesses or depressions 36' and 37' are preferably formed in the respective handle sections 36 and 37. In the preferred arrangement, the housing sections 34 and 35 are placed in respective molds which mold elastomeric material directly onto the handle sections 36 and 37 at the respective recesses 36' and 37'. This arrangement is illustrated in FIG. 6 which shows the handle section 37 received in a mold cavity 38 between mold sections 39 and 40. The handle section 37 fills part of the cavity 38 and itself forms part of a secondary cavity 38'. The cavity 38' is formed in part by a wall 39' of the mold section 39 and in part by the recess 37' and by terminal end 41 of the handle section 37. There is preferably a port (not shown) into the cavity 38' into which elastomeric material can flow. Alternatively, compression molding can be used.

Figure 8:
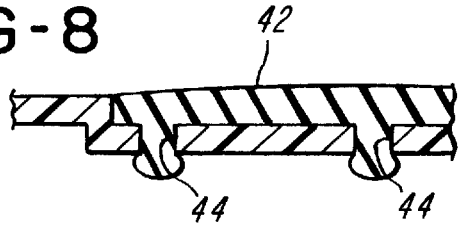
FIG. 8 is a sectional view taken generally along line 8—8 of FIG. 7, but showing the elastomeric member keyed to the handle section.

With reference to FIG. 7, an elastomer member 12' is comprised of the elastomeric sections 42 and 43 received in the respective recesses 36' and 37' shown exploded away. The cavities 36' and 37' have respective through-holes 44 and 45 into which the elastomeric material can flow. The elastomeric material thus keys the resulting elastomeric sections 42 and 43 to the respective handle members 36 and 37. FIG. 8 best shows the keying of the elastomeric section 42 to the handle section 36.

Figure 4:
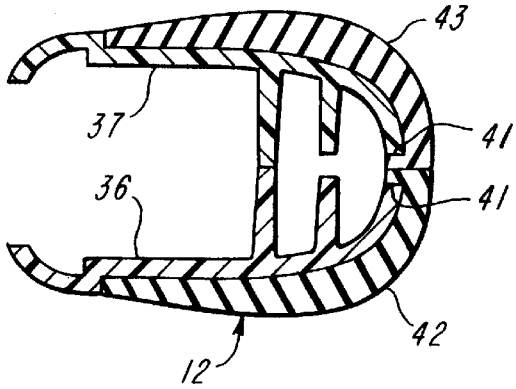

The handle 12 has a profile which varies along its length to accommodate to the palm of the user. The elastomeric sections 42 and 43 are preferably approximately as wide as the user's hand. The handle 12 is more bulbous in the central portion of the handle as shown in FIG. 4. As is apparent, the central portion of the handle 12 fits into the hollow of the user's palm.

The handle sections 36 and 37 are intentionally terminated at respective terminal ends 41 so as to provide a gap or space for flanges 42' and 43' along the entire edges 46 and 47 of irrespective elastomeric sections 42 and 43. The housing sections 34 and 35 are connected by snaps and by various transversely extending screws, such as screws 51 passing through holes 50 in housing section 35 and threaded into the housing section 34. The flanges 42' and 43' are held captive between terminal ends 41. More particularly, it is preferred that the distance between terminal ends 41 be less than the combined thickness of the abutting flanges 42' and 43'. The flanges 42' and 43' are shown to abut each other and the terminal ends 41 of the handle sections 36 and 37. When the screws are tightened, the flanges 42' and 43' are thus resiliently compressed. Because of this and because of the frictional nature of the elastomeric material of which the sections 42 and 43 are composed the sections 42 and 43 are secured to the handle members 36 and 37 along edges 46 and 47.

If desired, the elastomeric sections 42 and 43 can be molded separately, then fitted to the respective handle sections 36 and 37 and held, for example, by adhesive or other suitable means.

Figure 3:
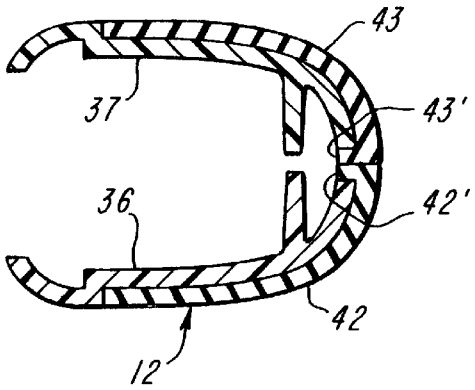
FIGS. 3, 4 and 5 are sectional views of the handle taken generally along respective lines 3—3, 4—4 and 5—5 of FIG. 1.
Figure 5:
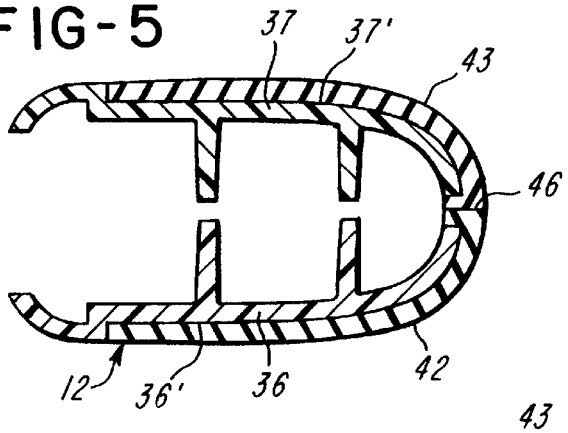

The elastomeric member 12' comprises a cushion or grip and constitute part of the composite handle 12. The cushion or grip 12' has a generally U-shaped configuration as shown particularly in FIGS. 3, 4 and 5.

The elastomeric member 12' provides a cushion for the user's hand. The elastomeric member 12' is compliant to accommodate hands of different sizes and shapes. At the same time, the elastomeric member offers frictional resistance so that the user can easily orient the handle 12 in his/her hand and so that the handle 12 will not slip in the user's hand.

By way of example, not limitation, one preferred elastomeric material is a thermoplastic rubber compound, for example, DYNAFLEX® G-6713-0001 sold by GLS Corporation, Thermoplastic Elastomeric Division, Cary, Ill., U.S.A.

The preferred durometer hardness is between 10 and 30 Shore A, with the most preferred being 25 Shore A.

Other embodiments and modifications of the invention will suggest themselves to those skilled in the art, and all such of these as come within the spirit of this invention are included within its scope as best defined by the appended claims.

What is claimed is:

1. Method of making a hand-held labeler, comprising the steps of: providing a housing having a manually graspable handle, the handle having a pair of handle sections, means on the housing for mounting a label supply roll of a composite web having labels releasably adhered to a carrier web, a platen, a print head cooperable with the platen for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle includes a substantially rigid handle member, and molding elastomeric material onto the handle.

2. Method as defined in claim 1, wherein the molding step includes keying the elastomeric material to the handle member.

3. A hand-held labeler, comprising: a housing having a manually graspable handle, wherein the housing includes a pair of opposed connected housing sections, wherein the handle includes a substantially rigid handle member, wherein the handle member includes a pair of the handle sections, wherein each handle section has a terminal end, the terminal ends being spaced apart to provide a gap, means on the housing for mounting a label supply roll of a composite web having labels releasably adhered to a carrier web, a platen, a print head cooperable with the platen for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle further includes an elastomeric member on the exterior of the handle member, the elastomeric member being receivable against the palm of the user's hand, each handle section having an elongate exterior recess, the elastomeric member including a pair of elastomeric sections, wherein each elastomeric section includes a flange, wherein the flanges are received in the gap, wherein the flanges abut each other and abut the terminal ends, and wherein the pair of elastomeric sections is received in the recesses of the handle sections.

4. A hand-held labeler as defined in claim 3, wherein the flanges are held under compression between the terminal ends.

5. A hand-held labeler, comprising: a housing having a manually graspable handle which subjects the user to impact during use, means on the housing for mounting a label supply roll of a composite web having labels releasably adhered to a carrier web, a platen, a print head cooperable with the platen at a printing position for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle includes a substantially rigid handle member, a frictional elastomeric member on the exterior of the handle member, the elastomeric member being receivable against the palm of the user's hand for helping to absorb the impact on the user's palm resulting from use of the labeler, wherein the housing includes a pair of opposed connected housing sections, each housing section including a handle section, wherein the handle member includes a pair of the handle sections, each handle section having an elongate exterior recess, the elastomeric member including a pair of elastomeric sections, and wherein the pair of elastomeric sections is received on the pair of handle sections.

6. A hand-held labeler, comprising: a housing having a manually graspable handle which subjects the user to impact during use, means on the housing for mounting a label supply roll of a composite web having labels releasably adhered to a carrier web, a platen, a print head cooperable with the platen at a printing position for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle includes a substantially rigid handle member, a frictional elastomeric member on the exterior of the handle member, the elastomeric member being receivable against the palm of the user's hand for helping to absorb the impact on the user's palm resulting from use of the labeler, and means for keying the elastomeric member to the handle member.

7. A hand-held labeler, comprising: a housing having a manually graspable handle which subjects the user to impact during use, means on the housing for mounting a label supply roll of a composite web having labels releasably adhered to a carrier web, a platen, a print head cooperable with the platen at a printing position for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle includes a substantially rigid handle member, a frictional elastomeric member on the exterior of the handle member, the elastomeric member being receivable against the palm of the user's hand for helping to absorb the impact on the user's palm resulting from use of the labeler, and wherein the elastomeric member is of variable thickness to accommodate the palm of the user's hand.

8. A hand-held labeler, comprising: a housing having a manually graspable handle which subjects the user to impact during use, means on the housing for mounting a label supply roll of a composite web having labels releasably adhered to a carrier web, a platen, a print head cooperable with the platen at a printing position for printing on the labels, means for delaminating printed labels from the carrier web, means for applying printed labels, means for advancing the composite web to peel a printed label from the carrier web and advance the printed label into label applying relationship with the label applying means and to advance another label into the printing position, wherein the advancing means includes an operating lever disposed at the handle and engageable by the user's fingers, wherein the handle includes a substantially rigid handle member, a frictional elastomeric member on the exterior of the handle member, the elastomeric member being receivable against the palm of the user's hand for helping to absorb the impact on the user's palm resulting from use of the labeler, wherein the elastomeric member extends lengthwise of the handle member, and wherein a central portion of the elastomeric member is thicker than end portions thereof.

* * * * *